US006368067B1

(12) United States Patent
Stutz

(10) Patent No.: US 6,368,067 B1
(45) Date of Patent: Apr. 9, 2002

(54) DUAL CHAMBER LIQUID PUMP

(75) Inventor: William A. Stutz, San Jose, CA (US)

(73) Assignee: Chemand Corporation, San Jose, CA (US)

( * ) Notice: Subject to any disclaimer, the term of this patent is extended or adjusted under 35 U.S.C. 154(b) by 0 days.

(21) Appl. No.: 09/644,025

(22) Filed: Aug. 22, 2000

(51) Int. Cl.[7] ..... F04F 1/18; F04F 1/06; F04F 3/00

(52) U.S. Cl. ..... 417/118; 417/54

(58) Field of Search ..... 417/118, 53, 54, 417/207, 393, 122; 128/214 F; 435/383, 283; 184/6; 222/386.5; 60/325

(56) References Cited

U.S. PATENT DOCUMENTS

| | | | | | |
|---|---|---|---|---|---|
| 3,648,694 | A | * | 3/1972 | Mogos et al. | 128/214 F |
| 3,883,269 | A | * | 5/1975 | Wolff | 60/122 |
| 4,086,765 | A | * | 5/1978 | Gillian | 60/325 |
| 4,462,760 | A | * | 7/1984 | Sarich et al. | 417/54 |
| 5,169,781 | A | * | 12/1992 | Nojima et al. | 435/283 |
| 5,279,504 | A | * | 1/1994 | Williams | 417/393 |
| 5,525,042 | A | * | 6/1996 | Batten | 417/118 |
| 5,571,261 | A | * | 11/1996 | Sancoff et al. | 222/386.5 |
| 6,042,342 | A | * | 3/2000 | Orian | 417/207 |
| 6,048,727 | A | * | 4/2000 | Kopf | 435/383 |
| 6,109,881 | A | * | 8/2000 | Snodgrass et al. | 417/53 |
| 6,286,627 | B1 | * | 9/2001 | Grach et al. | 184/6 |

* cited by examiner

*Primary Examiner*—Teresa Walberg
*Assistant Examiner*—Leonid M Fastovsky

(74) *Attorney, Agent, or Firm*—Robert O. Guillot; Oppenheimer Wolff & Donnelly LLP

(57) ABSTRACT

The fluid pump of the present invention includes an upper enclosure for holding fluid (typically a liquid) from a fluid input source, and a lower enclosure for outputting the fluid to an output line. A first valve (a) controls the fluid input flow into the upper enclosure. A second valve (b) is engaged in a line between the upper enclosure and the lower enclosure to control the fluid flow from the upper enclosure to the lower enclosure. A second fluid input line is engaged to the lower enclosure to input a second fluid (typically a pressurized gas) into the lower enclosure, and a third valve (d) is engaged in a line between the lower enclosure and upper enclosure to control the flow of the second fluid into the second enclosure. A fourth valve (c) is engaged in a fluid output line to control the flow of the second fluid out of the upper enclosure. In the preferred embodiments, each of valves a, b, c and d is controlled by an automated pump system controller. Various embodiments of the present invention include further valves and check valves to provide improved control in the system. The preferred embodiment of the dual chamber pump operates by outputting the liquid from the lower enclosure under a constant, controlled gas pressure. When the liquid level in the lower enclosure is low, the lower enclosure is filled with liquid from the upper enclosure. To accomplish this, the upper enclosure is pressurized to the same pressure as the lower enclosure, and because the upper enclosure is disposed above the enclosure, the gravitational head causes the liquid in the upper enclosure to flow into the lower enclosure. The upper enclosure is filled during the pump cycle in which the lower enclosure is outputting liquid. The pump thus has a repeatable cycle, although the gas pressure in the lower enclosure remains constant and liquid is constantly output from the pump at a controlled pressure.

32 Claims, 5 Drawing Sheets

DUAL CHAMBER LIQUID PUMP

BACKGROUND OF THE INVENTION

1. Field of the Invention

The present invention relates generally to devices for pumping liquid, and more particularly to a liquid pumping device that is activated by pressurized gas, and which includes an input chamber and an output chamber with valves to control both liquid and gas flow.

2. Description of the Prior Art

In nearly every fluid transfer application it is necessary to provide a pump to provide the motive force to move the liquid through a liquid supply line. With the exception of gravitational systems and siphon systems, the utilization of liquid pumps is a necessity and many types of pumps have been developed throughout history. Many of the pumps are powered by rotating or reciprocating motorized devices which tend to create a vibration or pulsation in the pumped liquid and the systems that utilize such pumps. For many applications the vibration and pressure pulsation of such pumps is insignificant and such pumps provide adequate performance.

However, many liquid transfer applications involve liquids having a delicate chemical make-up and chemical processes that are adversely affected by the pulsation and vibration of pumped liquid. For such applications it is necessary to utilize a pump that does not create pulsation and vibration of the pumped fluid. Additionally, many precise chemical processes require strict control of the flow rate of the pumped liquid, and prior art pumps that induce pulsation and vibration within the pumped fluids have difficulty meeting such flow rate constraints. Semiconductor fabrication processes are one such application in which ever stricter constraints on liquid pumping parameters continue to be developed. In many particular applications within the semiconductor fabrication industry pulsation and vibration of pumped chemicals adversely affects the delicate chemical balance of processing liquids as well as the chemical reactions of the processing liquids with the semiconductor substrates in the various fabrication steps.

A need therefore exists for pumps that move liquids without subjecting the liquids to pulsation and vibration, while providing tight control of the delivery pressure of the pumped liquids. The present invention, in its various embodiments disclosed herein, provides a pump system that utilizes pressurized gas to provide the motive force to continuously pump liquids through liquid flow lines. The pulsation and vibration created by the prior art pumping systems is eliminated and a strict control of pumped liquid delivery pressure is obtained.

SUMMARY OF THE INVENTION

The fluid pump of the present invention includes an upper enclosure for holding fluid (typically a liquid) from a fluid input source, and a lower enclosure for outputting the fluid to an output line. A first valve (A) controls the fluid input flow into the upper enclosure. A second valve (B) is engaged in a line between the upper enclosure and the lower enclosure to control the fluid flow from the upper enclosure to the lower enclosure. A second fluid input line is engaged to the lower enclosure to input a second fluid (typically a pressurized gas) into the lower enclosure, and a third valve (D) is engaged in a line between the lower enclosure and upper enclosure to control the flow of the second fluid into the second enclosure. A fourth valve (C) is engaged in a fluid output line to control the flow of the second fluid out of the upper enclosure. In the preferred embodiments, each of valves A, B, C and D is controlled by an automated pump system controller. Various embodiments of the present invention include further valves and check valves to provide improved control in the system. The preferred embodiment of the dual chamber pump operates by outputting the liquid from the lower enclosure under a constant, controlled gas pressure. When the liquid level in the lower enclosure is low, the lower enclosure is filled with liquid from the upper enclosure. To accomplish this, the upper enclosure is pressurized to the same pressure as the lower enclosure, and because the upper enclosure is disposed above the enclosure, the gravitational head causes the liquid in the upper enclosure to flow into the lower enclosure. The upper enclosure is filled during the pump cycle in which the lower enclosure is outputting liquid. The pump thus has a repeatable cycle, although the gas pressure in the lower enclosure remains constant and liquid is constantly output from the pump at a controlled pressure.

It is an advantage of the present invention that a liquid pump is provided which pumps liquid without vibration and pulsation.

It is another advantage of the present invention that a liquid pump is provided which pumps liquid at a constant pressure.

It is a further advantage of the present invention that a liquid pump is provided having an upper enclosure and a lower enclosure, such that liquid flowing from the lower enclosure can be replaced by liquid from the upper chamber without cessation in the liquid output flow.

These and other features and advantages of the present invention will become apparent to those skilled in the art upon review of the following detailed description which makes reference to the several figures of the drawing.

IN THE DRAWINGS

DETAILED DESCRIPTION OF THE PREFERRED EMBODIMENTS

Figure 1:
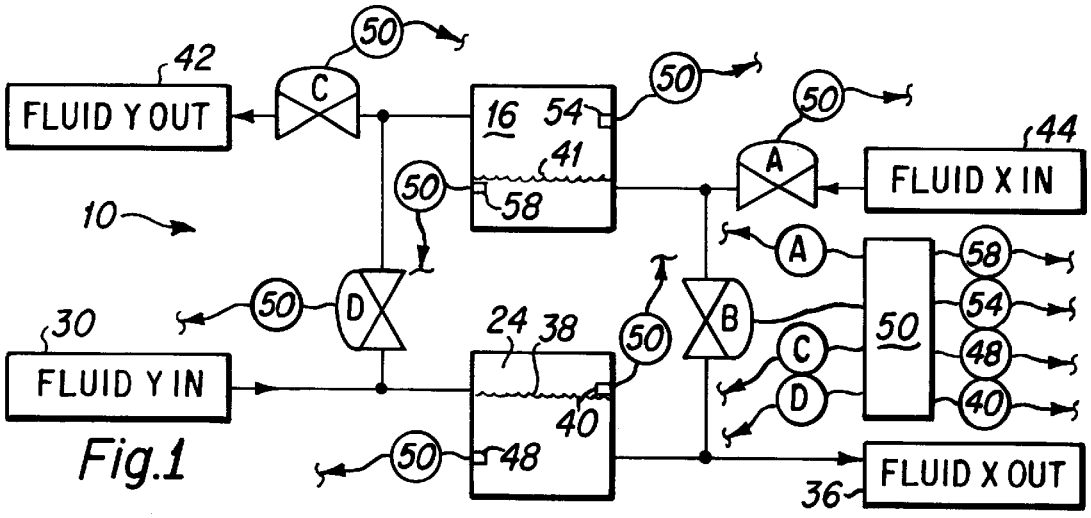
FIG. 1 is a schematic diagram depicting the basic features of the dual chamber liquid pump of the present invention.

FIG. 1 depicts a basic pump embodiment 10 with two (upper and lower) pressurizable liquid holding enclosures 16 and 24 respectively. Generally, gas pressure (fluid Y) is used to pump liquid (fluid X) out from lower enclosure 24 through the fluid X out line 36. When the liquid level 38 in the lower enclosure 24 is low, gas pressure is applied to the upper enclosure 16 to pump liquid therefrom into the lower enclosure 24 to fill it and also to simultaneously pump liquid out through the fluid X out line 36. When the lower enclosure 24 is full, the liquid flow from the upper enclosure 16 is halted, and liquid continues to flow from the lower enclosure 24 while the upper enclosure 16 is refilled. Thereafter, when the liquid level 38 in the lower enclosure 24 is again low, it is again filled from the upper enclosure 16, thus establishing a repeating cyclical process. The gas pressure in the lower enclosure 24 is always sought to be maintained at a constant value during pumping operations, such that a steady liquid flow rate out of the pump 10 is achieved with minimal disturbance of the liquid.

A detailed description of the operation of the pump 10 of FIG. 1 can be commenced from the pump state in which the liquid level 38 of the lower enclosure 24 is full as indicated by a liquid level sensor 40 and the liquid level 41 in the upper enclosure 16 is low. In this state, valve D is closed, such that gas (fluid Y) pressure is maintained in the lower enclosure 24 and valve C is open such that the upper enclosure 16 is at atmospheric pressure through the open fluid Y output line 42. Valve B is closed to prevent backflow of liquid from the lower enclosure 24, and liquid within the lower enclosure 24 is pumped from enclosure 24 through the outlet line 36 at a constant pressure, because the gas pressure in enclosure 24 is maintained at a constant value from the gas (fluid Y) inlet source 30. Valve A is open such that liquid (fluid X) from input line 44 is input through valve A into the upper enclosure 16. Therefore, while liquid is being pumped out of the lower enclosure 24, liquid is simultaneously filling the upper enclosure 16. This functional state continues until the liquid level in the lower enclosure 24 drops to a low level indicated by liquid level sensor 48, whereupon valve A is closed to prevent liquid backflow, valve C is closed, and valve D is opened to provide pressurized gas to the upper enclosure 16 at the same gas pressure as exists in the lower enclosure 24. Thereafter, valve B is opened to allow liquid to flow from the upper enclosure 16 under the influence of the pressurized gas within enclosure 16. The volume of liquid from the upper enclosure 16 flows thorough valve B and through the fluid outlet 36, and because the fluid from the upper enclosure 16 is pumped at the same gas pressure as the lower enclosure 24, the outlet fluid pressure remains constant and uninterrupted. Additionally, due to the gravitational liquid pressure head created because the upper enclosure 16 is disposed above the lower enclosure 24, a portion of the liquid from the upper enclosure 16 also flows into the lower enclosure 24 to fill it. When the liquid level in the lower enclosure 24 reaches the high liquid level sensor 40, valves D and B are closed and valves A and C are opened, thus returning the pump to its original state described above. That is, the gas pressure within the lower enclosure 24 pumps the liquid therein out to the outlet 36 while liquid is input through valve A into the upper enclosure 16 which is open to atmospheric pressure through valve C to gas output line 42.

Valves A, B, C and D as well as others described hereinbelow are preferably controlled by a system controller 50 that automatically opens and closes the valves in a predetermined sequence for proper pump operation. The system controller may also receive signals from the liquid level sensors 40 and 48 to control the pump. The valves may be of remote or automatic control type such as solenoid or gas operated valves. Such valves may be operated by various system controllers 50, such as an automated pump controller, that can include a pneumatic or electronic controller including but not limited to a computer based controller or a single-chip or multi-chip integrated circuit pump controller. Such system controllers 50 may perform other useful functions related or unrelated to the pump including controlling multiple pumps. Related pump functions such as total pumped volume, excessive output flow detection, and output flow rate computation are also possible with the aid of the sensors described herein.

A high liquid level sensor 54 and a low liquid level sensor 58 may be provided within the upper enclosure 16 to provide additional process control signals to the controller 50. For instance, the liquid level within the upper enclosure 16 should not become so high as to flow out through the gas inlet line towards valves C and D, so a signal from the high liquid level sensor 54 within the upper enclosure 16 will cause valve A to close to prevent overflow. Likewise, a signal from the low liquid level sensor 58 within the upper enclosure 16 will cause the system controller to take corrective measures to prevent pressurized gas within enclosure 16 from entering the liquid flow lines.

Sensors 40, 48, 54, 58 may provide a simple visual indication for a manually controlled pump or may be any of a wide variety of sensors when more elaborate pump control is desired. Suitable sensors will utilize one or more property of the fluids to produce an output signal or modulate an input signal to become an output signal in some communicative form. Some communicative forms are mechanical, electrical, and pneumatic outputs. A sensor may or may not be in direct contact with a fluid depending upon its mechanism. Preferably the sensors 40, 48, 54 and 58 function to provide signals to the system controller 50 when their respective enclosures are nearly full or nearly empty, to provide time for the system controller to properly control the appropriate pump valves to control the system. A single sensor may serve the function of more than one of the depicted sensors; for example a single sensor for upper enclosure 16 may indicate both nearly full and nearly empty. Also, a special case of detecting any liquid flow in the output line, when none is expected (thus indicating a system leak), may be effected by determining if sensor 40 indicates that the lower enclosure 24 becomes less than nearly full after having been last filled due to previous output flow.

There may be a number of cases when not all of the sensor points may be required. For example, when the geometry of the enclosures is arranged so that the sensor 40 level is the same as the sensor 58 level only one sensor is required to indicate these two levels. Additionally, when an input or output flow rate is known with acceptable accuracy, the sensor indicating the ending point of either the input or output levels respectfully may be replaced with a simple time delay.

Some pump configurations are practical which use no sensors and only time delays. One such case is where a liquid fluid X source 44 is fed by gravity, where a gas fluid Y out 42 returns to atmosphere at an altitude higher than the free surface of the liquid source, where the gas valves (D and C) may also be located higher than the free surface of the source, and the maximum flow rate of liquid fluid X is known.

It will also be understood by those skilled in the art that the upper enclosure 16 should typically hold and dispense sufficient liquid to both fill the lower enclosure 24 and to provide sufficient output liquid during the time it takes to fill the lower enclosure 24. It will also be understood that a pump which includes sensors 40, 54, and 58 but not necessarily sensor 48 need not have such a volume requirement for enclosure 16. Also, enclosure 24 must functionally hold and dispense sufficient output liquid during the time it takes to fill the upper enclosure 16. Additionally, while the pump 10 produces a constant output flow rate, the liquid input through valve A is periodic, in that valve A is closed when fluid is pumped from the upper enclosure 16. However, over repeated cycles, the total volume of fluid into the pump must equal the total volume of fluid out of the pump. Having described the basic operational features of the pump, several alternative and enhanced embodiments are next discussed.

Figure 2:
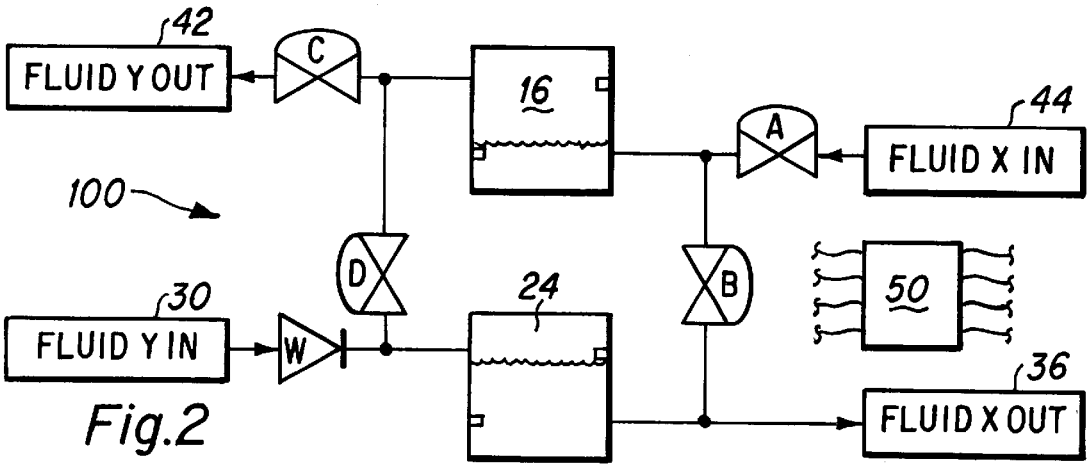
FIGS. 2–14 are schematic diagrams depicting alternative and enhanced embodiments of the basic dual chamber pump depicted in FIG. 1.

FIG. 2 depicts a first enhanced pump 100 that includes a check valve W placed into the fluid Y input line 30 of the pump 10 depicted in FIG. 1. Check valve W allows flow only from but not to the fluid Y input 30 thereby preventing backflow in cases of errors and failures. This one-way valve W is also useful in cases wherein fluid X is at least slightly soluble in fluid Y and for operational or safety reasons must be prevented from diffusing backward toward the source of fluid Y. One specific example is where this protection is useful is when corrosive liquid X outgasses into inert gas fluid Y and would diffuse to and react with and make fail the components or render hazardous the supply of gas fluid Y. Another example which also demonstrates a liquid-liquid pump is where fluid Y is an environmentally sensitive liquid such as water and fluid X is a contaminating liquid such as mercury.

Figure 3:
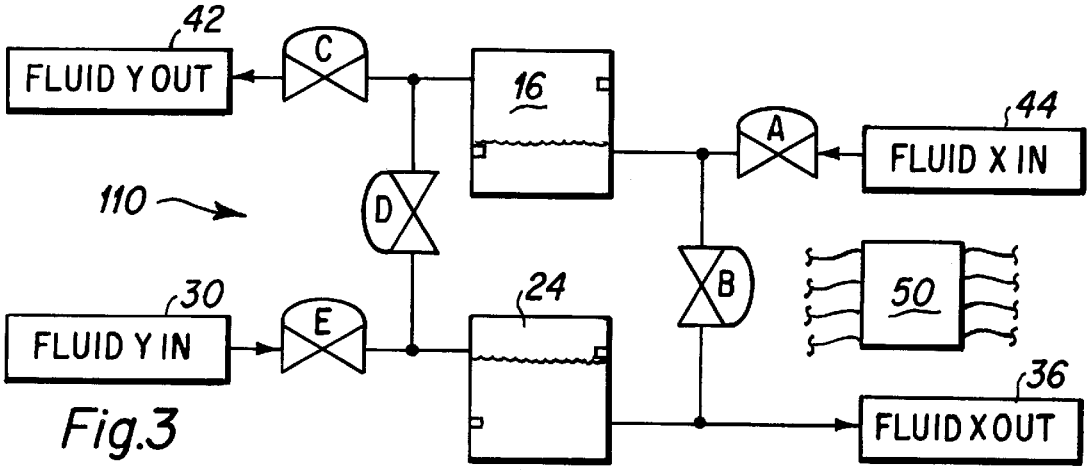

FIG. 3 is a schematic diagram that depicts another pump 110 in which a closable valve E replaces the check valve W of pump 100. Operational valve E allows that fluid Y may be blocked from entering the pump when it is closed. Blocking fluid Y will suspend operation of the pump 110 once the pressure in the lower enclosure 24 equals the backpressure from fluid X out 36. Setting valve E and C closed while opening valves A and B allows suspended operation of the pump 110 wherein fluid X in 44 and fluid X out 36 are at the same pressure thereby effecting a bypass mode. This bypass mode allows fluid X to flow in either direction between fluid X in and fluid X out without appreciable interference from the pump 110.

In a pump with fluid X out backflow prevention, described more fully below, valve A, valve C and valve E may all be closed to effectively isolate both enclosures and the remaining valves. This allows repair on parts of the pump without disturbing external connections. Further for any external port which is connected with an environmentally safe fluid and backpressure, the nearest valve may also be opened and/or manipulated for service. This is commonly true for the liquid fluid X and passive gas fluid Y case, where the fluid Y out port 42 is typically atmospheric exhaust. Furthermore, this specific case allows a gravity drain when valve E and valve A are closed and all others are set open provided the fluid X out line 36 includes a means or connection to drain.

Figure 4:
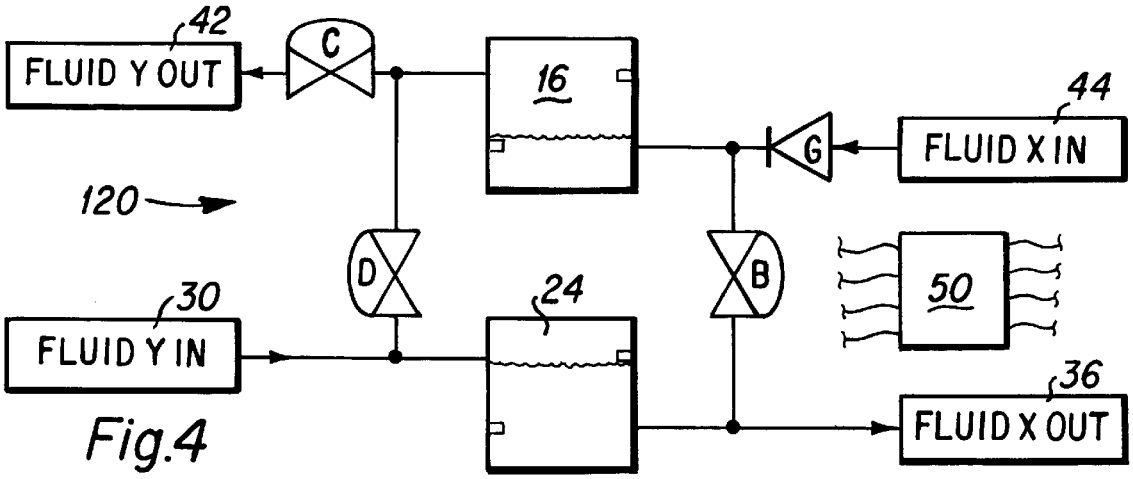

FIG. 4 is a schematic diagram which depicts another pump embodiment 120 in which a one-way check valve G replaces valve A of pump 10 depicted in FIG. 1. Some advantages of using a one-way check valve G are that there is one less valve which requires operation and that this type of valve is most often less costly than operable valves, and that pump throughput may be improved due to its rapid operation compared to other operable valves. Disadvantages are that one-way valves are often more restrictive to flow, cause direct pressure drops due to the checking mechanism which reduces pressure available to fill the upper enclosure 16, cause noise and shock waves when closing which may disturb fluid X or other equipment, and may not close reliably for some fluid X media such as particulate slurries.

Figure 5:
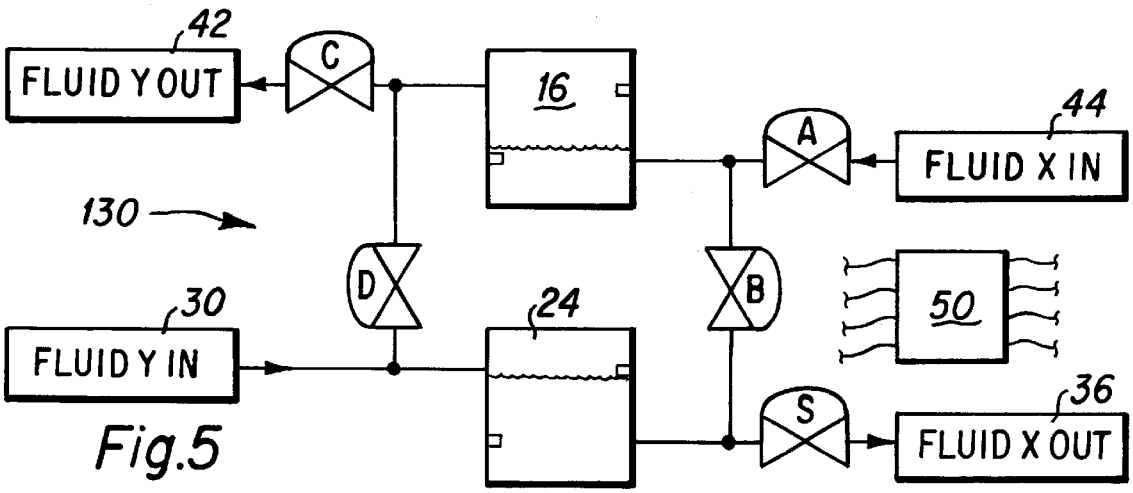

FIG. 5 is a schematic diagram which depicts a further enhanced pump 130 which includes a fluid X output valve S in the output line 36 of pump 10. Valve S provides a means to practically block the fluid X out line 36 so that the pump may be isolated from the pump's destination environment of equipment. There are many reasons this shutoff functionality may be useful, including to provide for maintenance or repair, to allow multiple pumps or pump subsections to share a common discharge or distribution line or open environment, and to provide for control of the flow of fluid X for the benefit of consumption elements connected to this output line 36. Various types of valves S may be used for the benefit of fluid X consuming elements such as flow restricting valves, pressure regulating valves, excessive pressure shutoff valves, excessive flow protection valves, excessive temperature shutoff valves, manually actuated valves, automatically actuated valves, and others. Multiple valves S of differing function may be connected in series or other arrangement. The specific case of a one-way check valve is discussed herebelow with regard to FIG. 6 to provide detail.

Figure 6:
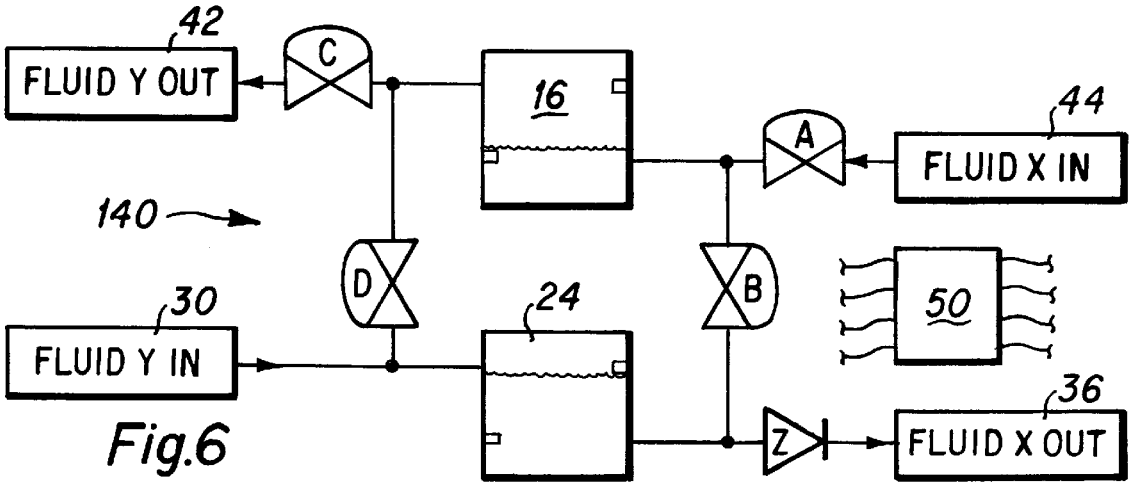

FIG. 6 is a schematic diagram that depicts another pump embodiment 140 in which valve S of embodiment 130 (FIG. 5) is replaced with a check valve Z. Check valve Z allows flow only to but not from fluid X out 36 thereby preventing backflow in cases of errors, failures and to allow sharing of the fluid X out path 36 with other systems. This sharing allows that multiple pumps may deliver to one or more fluid X destinations to improve flow when more than one pump operates at one time, to provide redundancy when at least one pump is held out of operation until needed, to provide for a multiplicity of source locations where pumps are displaced from each other. Multiple pumps handling differing fluid X liquids may be used to share a common fluid X out line to save multiple lines or to cause intentional mixing, blending or common discharge. In all cases valve Z prevents backflow into the pump from its output thus preventing what are assumed undesirable effects.

Figure 7:
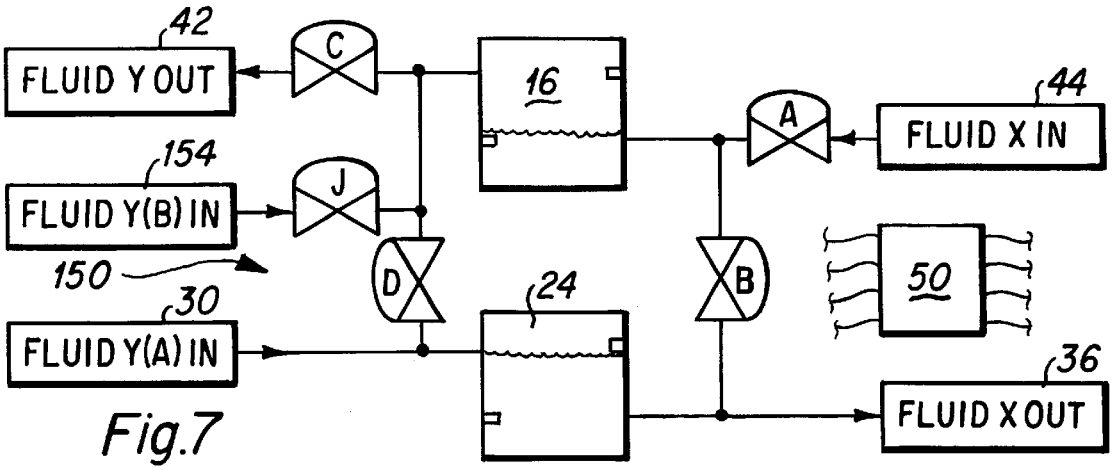

FIG. 7 is a schematic diagram that depicts a further pump embodiment 150 in which an additional fluid Y input line 154 is provided with a control valve J. Valve J provides for an independent supply of fluid Y to the upper enclosure 16. It is particularly useful in the liquid fluid X and gas fluid Y case during pressurization of the upper enclosure 16. Before pressurization enclosure 16 is relatively full of liquid fluid X but does contain at least a small volume of gas fluid Y at the low backpressure of fluid Y out 42. With valve D acting alone, as in pump embodiment 10 the gas fluid Y comes more directly from the lower enclosure 24 than from the pressure source via fluid Y(A) in 30. The pressure in the lower enclosure 24 reduces or surges lower quickly, then returns higher as the upper enclosure 16 pressurizes. Valve J is therefore opened before valve D to pressurize the upper enclosure 16 from independent source fluid Y(B) in 154 since they are at the same pressure and valve J is open. It may be desirable to close valve J after the upper enclosure 16 is pressurized to prevent the possibility of backflow of fluid Y to the separate source of fluid Y(B) 154, in that it is possible that the two sources of fluid Y may not be at sufficiently the same pressures to prevent such backflow.

Figure 8:
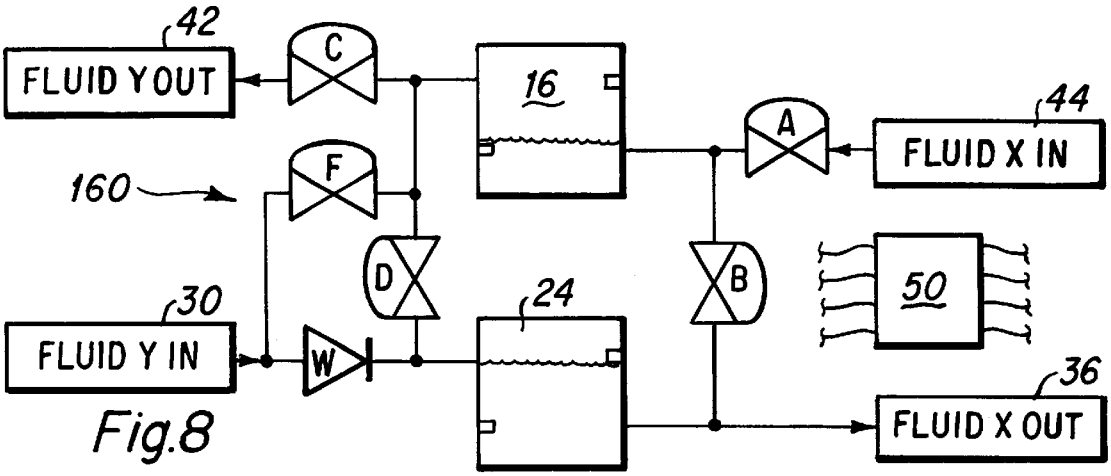

FIG. 8 depicts yet another pump embodiment 160 in which a check valve W is included in the fluid Y in line 30 to the lower enclosure 24 of pump embodiment 150 depicted in FIG. 7, and a second line with a control valve F is provided from the fluid Y in line 30 to the upper enclosure 16. Valve W thus serves to prevent backflow from the lower enclosure 24 towards the fluid Y in line 30. Valve W performs an additional function when used in conjunction with valve F. In this case rapid pressure reductions in the lower enclosure 24 are mitigated when valve F is opened to pressurize the upper enclosure 16 even though only a single source of fluid Y in is provided. The one way action of valve W inhibits the flow of compressible fluid Y from the lower enclosure 24 even though the available pressure at the fluid Y in line 30 may decrease substantially due to characteristics of its source. Pressurization of the upper enclosure 16 most often occurs when it is appreciably full of fluid X and therefore contains a relatively small volume to be pressurized by gas fluid Y. Also, the work efficiency of this pump improves as the upper enclosure 16 is filled closer to full and as the connections between it and valve C and valve D are reduced to smaller volumes. This is due to the fact that work performed compressing gas in these volumes is lost work that is not used to move liquid fluid X. These factors all tend to make the use of check valve W an effective means to reduce negative pressure surges to desired minimums.

Figure 9:
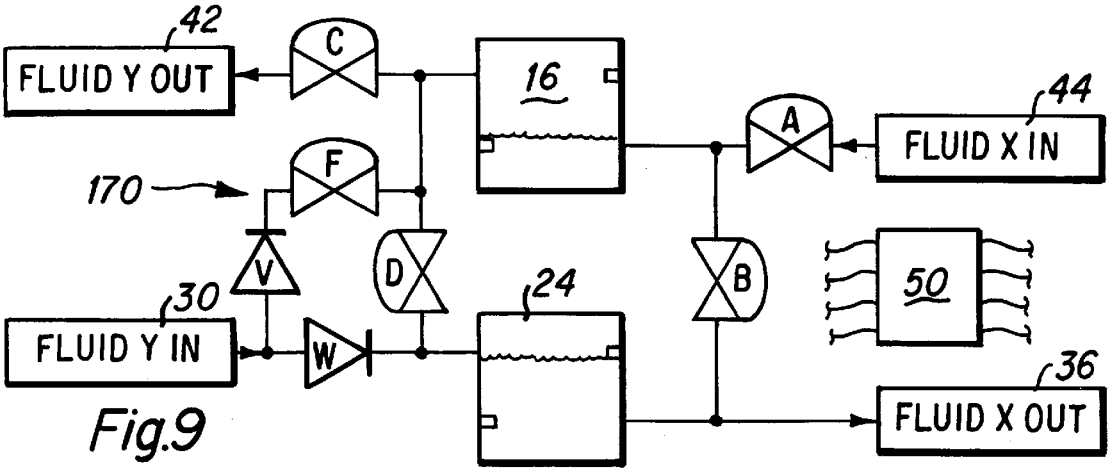

FIG. 9 is a schematic diagram depicting still another pump embodiment 170 in which a further check valve V is included between fluid Y in line 30 and valve F. Valve V provides additional backflow prevention for pumps which include valve F and valve W. This pump 170 is optimized for the low pressure variations on fluid X out 36 when the upper enclosure 16 changes pressure. Generally valve F need not be open when significant backflow is possible during normal operation but backflow prevention is often necessary during an abnormal operation such as another valve failure. Valve V thus provides such backflow protection when valve F is open for any reason. Valve V also provides additional pressure surge reduction functionality. The inclusion of valve V in the input path of fluid Y to valve F tends to mimic and match the presence of valve W in the input path of fluid Y to the lower enclosure 24. Many one-way check type valve have a "cracking pressure" drop which represents a pressure loss across the valve when opened by media flow.

Without valve V this pressure drop across valve W manifests as pressure surge when valve F opens in that the upper enclosure 16 will pressurize to a higher pressure than the lower enclosure 24 by an amount equal to the 'cracking pressure', and then subsequent to closing valve F depressurize to the normal pressure of enclosure 24. The nominal pressure of enclosure 24 is fluid Y in 30 pressure less the forward cracking pressure of valve W. The inclusion of valve V which is ideally similar to value W in cracking pressure value reduces the pressure in the upper enclosure 16 with valve F open to the same target value as that of the lower enclosure 24 thereby minimizing pressure surges.

Figure 10:
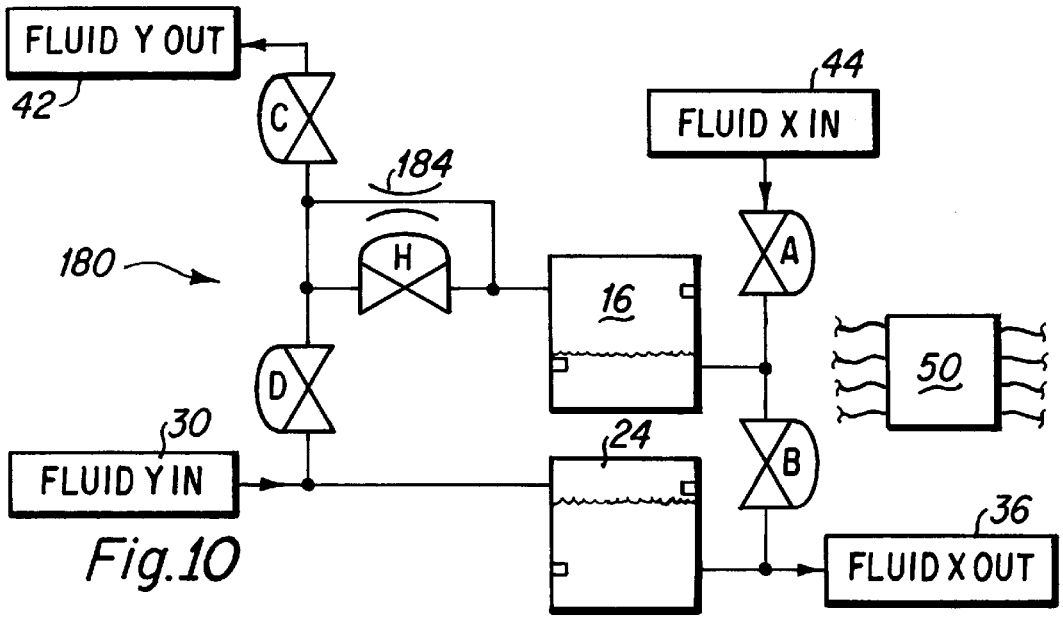

FIG. 10 is a schematic diagram depicting another pump embodiment 180 which includes a flow restriction device 184 which may be a specific valve or simply some properly sized additional piping disposed in a parallel relationship with a valve H to the upper enclosure 16. The combination of valve H and restriction 184 provide pressure surge reduction functionality when the gas pressure within the upper enclosure 16 is reduced. To pressurize upper enclosure 16, valves D and H are opened with valve C closed, and enclosure 16 is thereby rapidly pressurized. To depressurize enclosure 16 valve D is closed and valve C is opened, whereupon gas commences to leak slowly through restriction 184, such that a rapid pressure reduction surge is avoided. Thereafter, valve H is opened to allow more rapid flow of gas from the enclosure 16. The restriction 184 thus serves to prevent pressure surges, which create undesirable effects including but not limited to liquid flow rate surges within the pump 180.

Figure 11:
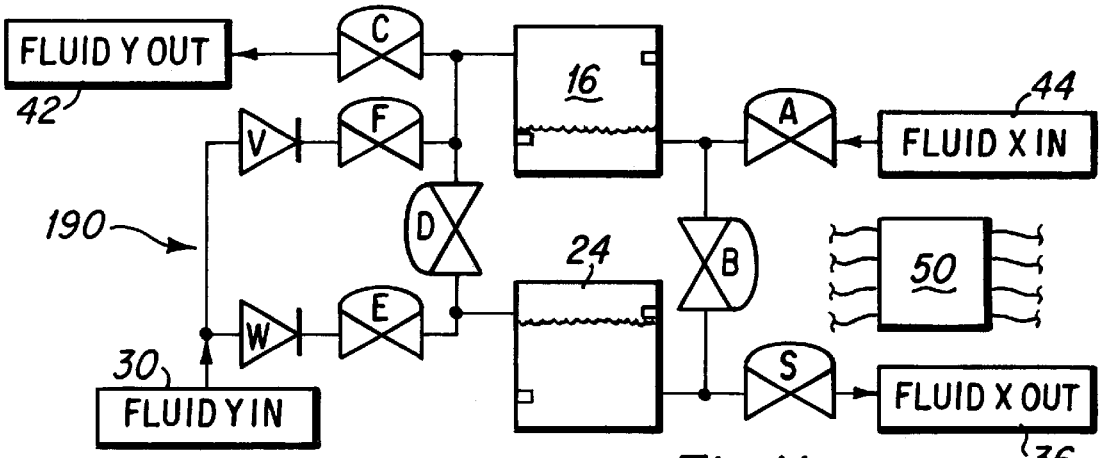

FIG. 11 depicts yet another pump embodiment 190 having a combination of valves, which demonstrates that many features may be superimposed together. This arrangement provides for substantial surge suppression features and full shutoff functionality for both fluid X and fluid Y. One significant aspect of valve arrangement containing valves C, D, E, and F is in simplification of control thinking in that valves C and F may operate as compliments and that valves D and E may operate as compliments. Operating as compliments here means that at any time if one is open then the other is closed. This is useful in implementations that use automated control in that all four of these valves need be served by only two logical controls.

Figure 12:
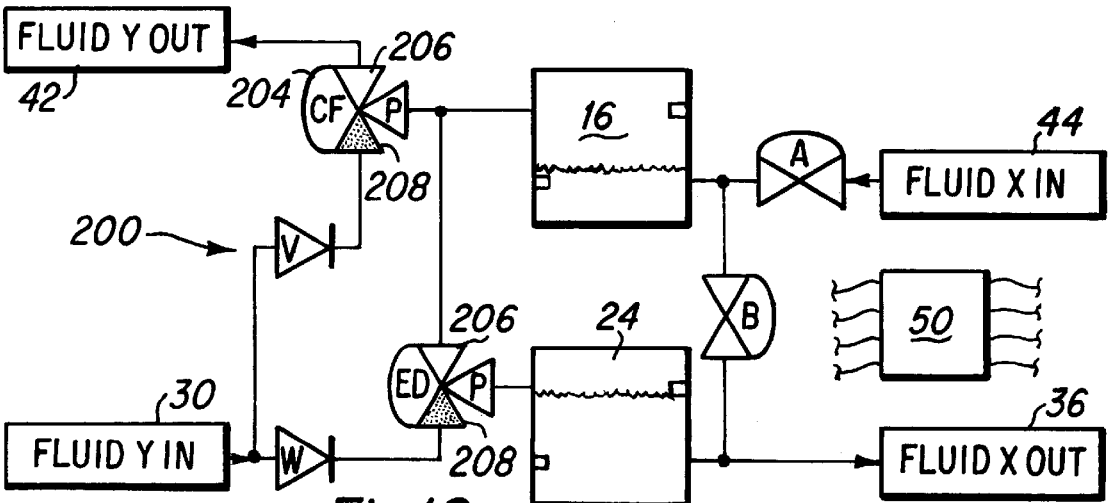

FIG. 12 depicts yet a further pump embodiment 200 in which two two-way valves which may operate as compliments are merged into single three-way valves. A three-way valve such as valve 204 has a common port ('P'), a normally open port 206 (clear triangle) and a normally closed port 208 (filled triangle). When closed the valve 204 connects and allows flow between the common port P and the normally open port 206 while blocking the normally closed port 208. When opened the valve 204 connects and allows flow between the common port P and the normally closed port 208 while blocking the normally open port 206. In this case valves CF and ED are three-way valves reduced from compliments of two-way valves in previously shown topologies.

Figure 13:
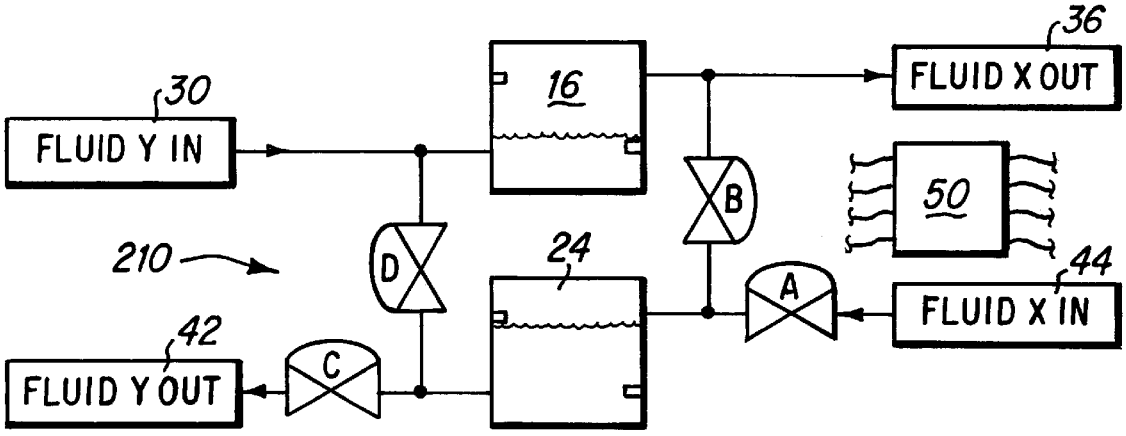

FIG. 13 depicts still another pump embodiment 210 in which fluid X is less dense than fluid Y. Fluid X thus exits from the enclosures 16 and 24 from the higher connection line positions. When fluid X is a gas the work efficiency of this pump improves as the lower enclosure 24 is filled closer to full and as the connections between it and valve A and valve B are made smaller volumes. This is due to the fact that work performed compressing these volumes is lost work that is not used to move gas fluid X. Also that the ratio of maximum to minimum gas volume (compression ratio) of the lower enclosure 24 must be large enough to develop a pressure due to the compression of the gas (fluid X) equal to the pressure of fluid Y in 30. Additionally, note that it is possible in some cases for a gas fluid X in to be compressed enough to change phase to a liquid within the lower enclosure 24 and then be transferred to the upper enclosure 16 for delivery as a liquid fluid X out.

Figure 14:
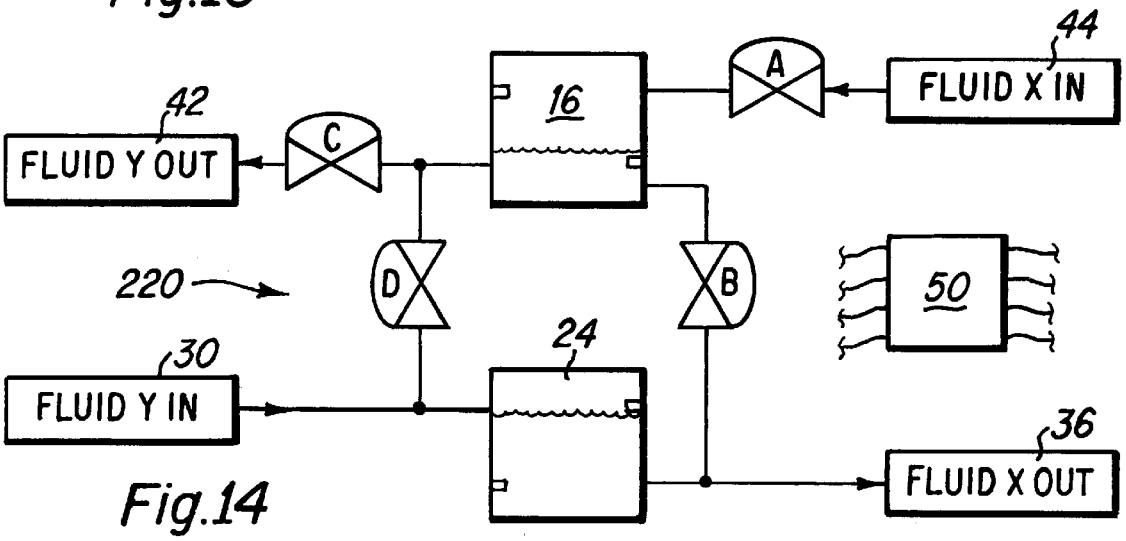

FIG. 14 depicts still a further pump embodiment 220 in which a gas phase fluid X in 44 is transformed into a liquid phase fluid X for pumping out as fluid X out 36. For the purposes of determining fullness of the enclosures there must be a way to discriminate a difference between fluid X and fluid Y even when both are liquids. Any convenient property of the fluids may be explored for this purpose. The fluids will always differ in their densities since this pump functions properly if the fluids differ in density to a degree necessary to keep separated in their respective fluid out ports. In this case of compressing a gas to a liquid phase in the upper enclosure 16, the liquid fluid X once produced migrates through the liquid fluid Y settling to the bottom of the enclosure. Adequate time must be provided for this migration and separation to occur before transfer to the lower enclosure 24 begins. Furthermore, since any residual liquid fluid X remaining within the upper enclosure 16 and output piping will return to gas phase when the enclosure 16 is depressurized through valve C, a specific shape of enclosure may be desirable to prevent this gas from exiting with the fluid Y but rather simply boil away to the higher altitudes of the enclosure 16.

While the present invention has been shown and described with regard to certain preferred embodiments, it is to be understood that those skilled in the art will no doubt develop certain alterations and modifications thereto which nevertheless include the true spirit and scope of the invention. It is therefore intended that the following claims cover all such alterations and modifications thereof which nevertheless do include the true spirit and scope of the present invention.

What is claimed is:

1. A dual chamber fluid pump comprising:

an upper enclosure being adapted for inputting a first fluid thereinto from a first fluid source;

a lower enclosure being adapted for outputting said first fluid therefrom to a first fluid output line;

a first valve (A) being engaged between said first fluid source and said upper enclosure for controlling the flow of said first fluid from said first fluid source to said upper enclosure;

a second valve (B) being engaged between said upper enclosure and said lower enclosure to control the flow of said first fluid from said upper enclosure to said lower enclosure;

an input line for a second fluid being engaged to said lower chamber to provide a second fluid from a second fluid source to said lower enclosure;

a third valve (D) being engaged between said second fluid source and said upper enclosure to control the flow of said second fluid into said upper enclosure;

a fourth valve (C) being engaged to said upper enclosure and operable to control the flow of said second fluid from said upper enclosure to a second fluid output line.

2. A pump as described in claim 1 wherein said first fluid is a liquid and said second fluid is a gas.

3. A pump as described in claim 1 further including:

a controller being operable to control the flow of said first fluid into and out of said upper enclosure and said lower enclosure, and to control the flow of said second fluid into and out of said upper enclosure and said lower enclosure.

4. A pump as described in claim 3 further including a fluid level sensing device disposed within said lower enclosure that provides control signals to said controller, and wherein said controller provides control signals to control said valves A, B, C and D.

5. A pump as described in claim 3 wherein said valves A, B, C and D are controlled in a timer mode by said controller.

6. A pump as described in claim 4, further including a check valve (W) being engaged between said second fluid source and said lower enclosure to prevent backflow of fluid towards said second fluid source.

7. A pump as described in claim 4, further including a controllable valve (E) being disposed between said second fluid source and said lower enclosure to control the flow of said second fluid into said pump.

8. A pump as described in claim 4, further including a check valve (G) being disposed between said first fluid source and said upper enclosure for preventing the backflow of said first fluid towards said first fluid source.

9. A pump as described in claim 4, further including a controllable valve (S) being disposed between said lower enclosure and said first fluid output line to control the output of said first fluid from said pump.

10. A pump as described in claim 4, further including a check valve (Z) being disposed between said lower enclosure and said first fluid output line to prevent the backflow of fluid from said first fluid output line into said pump.

11. A pump as described in claim 4, further including a second second fluid input line being engaged between valve D and said upper enclosure to provide said second fluid to said upper enclosure.

12. A pump as described in claim 11 wherein a fluid control valve (J) is engaged in said second second fluid input line.

13. A pump as described in claim 4, further including a check valve (W) being disposed between said second fluid source and said lower enclosure, and a controllable valve (F) being engaged between said second fluid source and said upper enclosure to control fluid from said second fluid source.

14. A pump as described in claim 13 wherein a check valve (V) is disposed between said second fluid source and valve F to prevent backflow of fluid towards said second source.

15. A pump as described in claim 4, further including a controllable valve (H) being engaged between said upper enclosure and valve C to control the flow of said second fluid from said upper enclosure to valve C, and wherein a flow restriction device is disposed in a parallel relationship with valve H.

16. A pump as described in claim 4, further including a fluid control valve (E) being engaged between said second fluid source and said lower enclosure to control the flow of said second fluid to said lower enclosure and to valve D.

17. A pump as described in claim 16 wherein control valves E and D are replaced by a three-way valve (ED), and wherein valves C and F are replaced by a three-way valve (CF).

18. A pump as described in claim 17 wherein a check valve (V) is disposed between said second fluid source and valve CF to prevent backflow of fluid towards said second source, and a check valve (W) is disposed between said second fluid source and valve ED to prevent backflow of fluid towards said second source.

19. A pump as described in claim 4, wherein said second fluid is denser than said first fluid, and wherein said first fluid is input into said lower enclosure and output from said upper enclosure during at least a portion of a cycle of pumping operations of said pump.

20. A pump as described in claim 4 wherein said first fluid inlet into said upper enclosure in a gaseous phase, and output from said lower enclosure in a liquid phase during at least a portion of an operating cycle of said pump.

21. A method for pumping liquid comprising the steps of:

inputting liquid into an upper enclosure of a dual chamber pump;

controlling a gas pressure within said upper enclosure to cause said liquid within said upper enclosure to flow to a lower enclosure of said pump;

controlling a gas pressure within said lower enclosure of said pump to cause said liquid to constantly flow out of said lower enclosure.

22. A method for pumping liquid as described in claim 21 wherein said step of controlling the gas pressure within said lower enclosure includes the step of determining the liquid level within said lower enclosure.

23. A method for pumping liquid as described in claim 22 wherein said step of controlling the gas pressure within said upper enclosure includes the step of increasing the gas pressure within said upper enclosure when said liquid level within said lower enclosure is low.

24. A method for pumping liquid as described in claim 23 wherein said step of increasing said gas pressure within said upper enclosure causes liquid within said upper enclosure to flow into said lower enclosure.

25. A method for pumping liquid as described in claim 22 wherein said step of controlling the gas pressure within said upper enclosure includes the step of decreasing the gas pressure within said upper enclosure when said liquid level within said lower enclosure is high.

26. A method for pumping liquid as described in claim 25 wherein said step of decreasing said gas pressure within said upper enclosure causes liquid to flow into said upper enclosure from a liquid source.

27. A method for pumping liquid as described in claim 21 wherein said step of controlling the gas pressure within said upper chamber includes the steps of altering said gas pressure within said upper enclosure at predetermined time intervals.

28. A method for pumping liquid as described in claim 27 wherein said step of altering said gas pressure within said upper enclosure causes liquid to flow from said upper enclosure to said lower enclosure.

29. A method as described in claim 21 wherein a controllable valve (A) is disposed between a liquid source and said upper enclosure to control the flow of liquid into said upper enclosure;

a controllable valve (B) is disposed between said upper enclosure and said lower enclosure to control the flow of said liquid between said upper enclosure and said lower enclosure;

a controllable valve (D) is disposed between a gas source and said upper enclosure to control the flow of said gas into said upper enclosure; and a controllable valve (C) is disposed between said upper enclosure and a gas output line to control the flow of said gas from said upper enclosure to said gas outlet line.

30. A method as described in claim 29, wherein a pump system controller provides control signals to said valves A, B, C and D to control the opening and closing of said valves.

31. A method as described in claim 30 wherein control signals related to the liquid level within said lower enclosure are provided to said system controller to operationally influence the control of valves A, B, C and D by said system controller.

32. A method as described in claim 31 wherein said lower enclosure liquid level control signals include a low liquid level signal and a high liquid level signal.

* * * * *